US007249413B2

(12) United States Patent
Kanada et al.

(10) Patent No.: US 7,249,413 B2
(45) Date of Patent: Jul. 31, 2007

(54) METHOD FOR MANUFACTURING INKJET PRINTING HEAD

(75) Inventors: Hideki Kanada, Aichi (JP); Hikoharu Aoki, Aichi (JP); Atsuo Sakaida, Gifu (JP); Kazuo Kobayashi, Gifu (JP); Yoshihumi Suzuki, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 433 days.

(21) Appl. No.: 10/874,321

(22) Filed: Jun. 24, 2004

(65) Prior Publication Data

US 2005/0011071 A1 Jan. 20, 2005

(30) Foreign Application Priority Data

Jun. 30, 2003 (JP) ..... 2003-188944

(51) Int. Cl.
*B21D 53/76* (2006.01)
*B41J 2/045* (2006.01)

(52) U.S. Cl. ..... 29/890.1; 29/25.35; 29/840; 29/843; 347/68

(58) Field of Classification Search ..... 29/890.1, 29/25.35, 840, 843; 347/68, 69, 70–72; 228/190, 228/185, 174, 120; 310/328, 330, 331; 156/89.11, 156/256

See application file for complete search history.

(56) References Cited

U.S. PATENT DOCUMENTS

| | | | | |
|---|---|---|---|---|
| 4,528,575 | A | 7/1985 | Matsuda et al. | |
| 5,289,209 | A * | 2/1994 | Suzuki et al. | 347/71 |
| 5,752,303 | A * | 5/1998 | Thiel | 29/25.35 |
| 5,872,583 | A | 2/1999 | Yamamoto et al. | |
| 6,270,203 | B1 * | 8/2001 | Kitahara et al. | 347/70 |
| 6,290,340 | B1 * | 9/2001 | Kitahara et al. | 347/70 |
| 6,584,687 | B1 | 7/2003 | Yamamoto et al. | |
| 2003/0112299 | A1 | 6/2003 | Kitahara | |

FOREIGN PATENT DOCUMENTS

| | | |
|---|---|---|
| EP | 1 321 294 A2 | 6/2003 |
| EP | 1 356 939 A2 | 10/2003 |
| JP | U 58-147749 | 10/1983 |
| JP | A-9-039243 | 2/1997 |
| JP | A-10-166599 | 6/1998 |
| JP | A-11-179900 | 7/1999 |
| JP | A 11-254681 | 9/1999 |

* cited by examiner

*Primary Examiner*—A. Dexter Tugbang
*Assistant Examiner*—Tai Van Nguyen
(74) *Attorney, Agent, or Firm*—Oliff & Berridge, PLC

(57) ABSTRACT

A method of manufacturing an ink jet printing head includes: forming a first laminated structure by laminating at least two metal plates having a hole formed thereon and fixing the metal plates to one another by metal-metal junction, and by laminating a plurality of thin plate members having a hole formed thereon, the thin plate members including the metal plates, and fixing the thin plate members to one another; forming a second laminated structure that includes at least a part of a common ink chamber, by laminating a plurality of thin plate members having a hole formed thereon and fixing the thin plate members to one another; and fixing the first laminated structure and the second laminated structure to each other while laminating the first laminated structure and the second laminated structure on each other.

21 Claims, 12 Drawing Sheets

METHOD FOR MANUFACTURING INKJET PRINTING HEAD

BACKGROUND OF THE INVENTION

1. Field of the Invention

The present invention relates to a method for manufacturing an inkjet printing head for ejecting ink onto a recording medium to perform printing.

2. Description of the Related Art

An inkjet printer includes at least one inkjet printing head having nozzles disposed therein so that ink can be ejected from the nozzles to apply printing onto a printing medium. In such an inkjet printing head, it is necessary to form complex and accurate ink flow paths in the inside of the inkjet printing head. Therefore, the inkjet printing head is formed by lamination of thin plate-like etching plates. To laminate and bond the etching plates on one another surely, for example, use of an adhesive agent such as an epoxy adhesive agent, a polyimide adhesive agent or an acrylic adhesive agent may be thought of. However, when the amount of the adhesive agent applied is large, the adhesive agent may flow into ink flow paths formed in the inside of the inkjet printing head. As a result, there is a possibility that the ink flow paths will be narrowed or blocked with the adhesive agent. Therefore, an inkjet printing head manufactured in such a manner that thin plate-like etching plates are laminated and bonded onto one another by means of diffusion junction which is one of metal-metal junction methods has been proposed (e.g., see page 4 of JP-UM-A-58-147749 (1983)). According to this technique, the thin plate-like etching plates can be fixed to one another with strong bonding force while the ink flow paths can be prevented from being narrowed or blocked because the adhesive agent is not used so that a surplus of the adhesive agent does not flow into the ink flow paths.

SUMMARY OF THE INVENTION

In a bonding process using metal-metal junction, it is necessary to apply a predetermined pressure in a bonding direction onto a subject of bonding in a vacuum atmosphere. However, if such a predetermined pressure is applied in a bonding direction of the etching plates when a large-size ink flow path (common ink chamber) having a large opening is formed in the inside of the inkjet printing head, the etching plate laminated so as to be adjacent to the common ink chamber is insufficiently supported in the direction of application of the pressure by the layer forming the common ink chamber. As a result, the etching plate is distorted so as to be curved convexly toward the common ink chamber. Accordingly, a gap is formed between the etching plate adjacent to the common ink chamber and another etching plate adjacent to the etching plate, so that the predetermined pressure in the bonding direction cannot be applied on the portion of the gap. For this reason, it is impossible to obtain a sufficient bonding strength between the etching plate adjacent to the common ink chamber and another etching plate adjacent to the etching plate. In addition, reliable metal-metal junction cannot be achieved because the size of other ink flow paths formed from these etching plates may be deformed.

Therefore, one of objects of the invention is to provide a method for manufacturing an inkjet printing head in which even in the case where a common ink chamber is formed in the inside of the inkjet printing head, a plurality of metal plates located near to the common ink chamber can be fixed to one another by metal-metal junction surely.

According to one aspect of the invention, there is provided a method of manufacturing an inkjet printing head, the method including: forming a first laminated structure that includes at least a part of an individual ink flow path having a pressure chamber and leads ink from an outlet of a common ink chamber to a nozzle through the pressure chamber, by laminating at least two metal plates having a hole formed thereon and fixing the metal plates to one another by metal-metal junction, and by laminating a plurality of thin plate members having a hole formed thereon, the thin plate members including the metal plates, and fixing the thin plate members to one another; forming a second laminated structure that includes at least a part of the common ink chamber, by laminating a plurality of thin plate members having a hole formed thereon and fixing the thin plate members to one another; and fixing the first laminated structure and the second laminated structure to each other while laminating the first laminated structure and the second laminated structure on each other.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

First Embodiment

Figure 1:
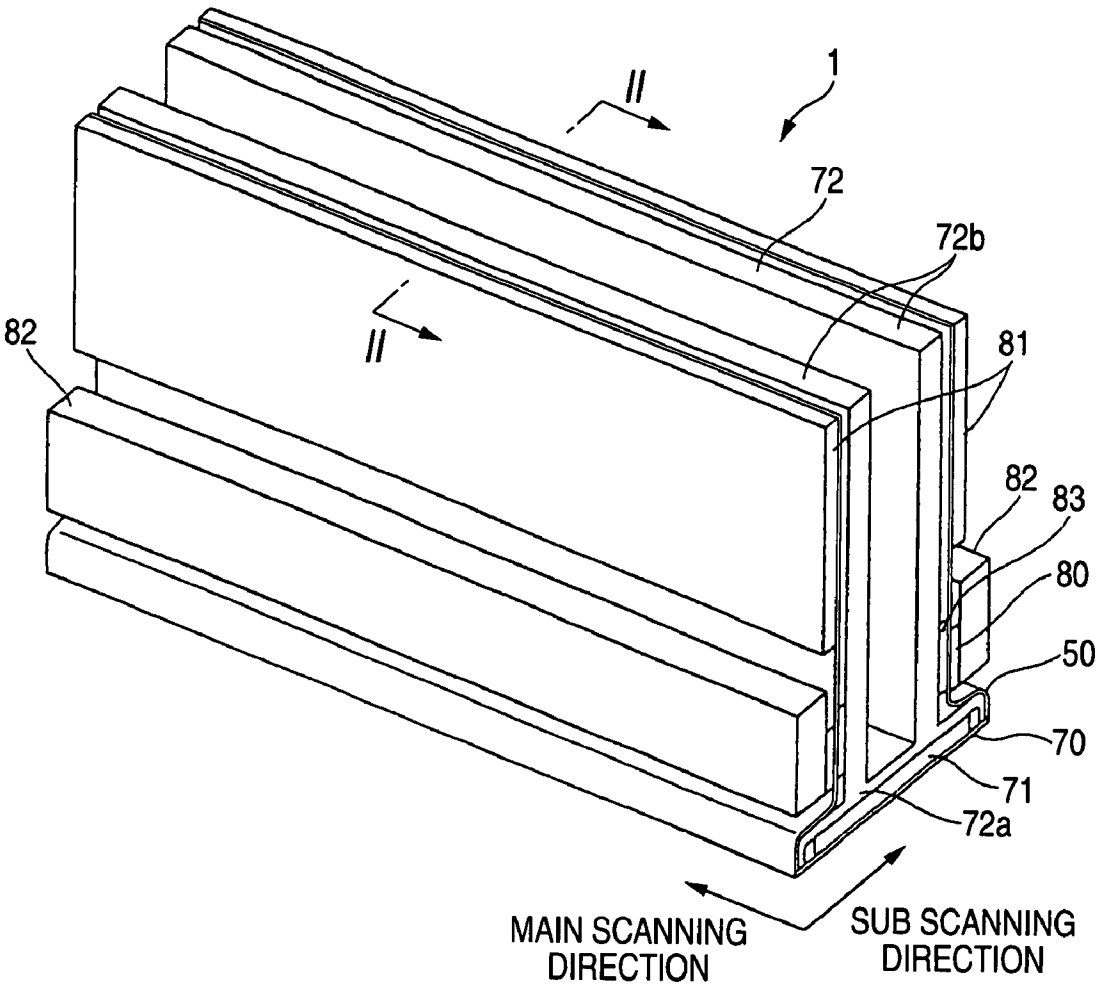
FIG. 1 is a perspective view of an inkjet printing head manufactured by an inkjet printing head manufacturing method according to a first embodiment of the invention.
Figure 2:
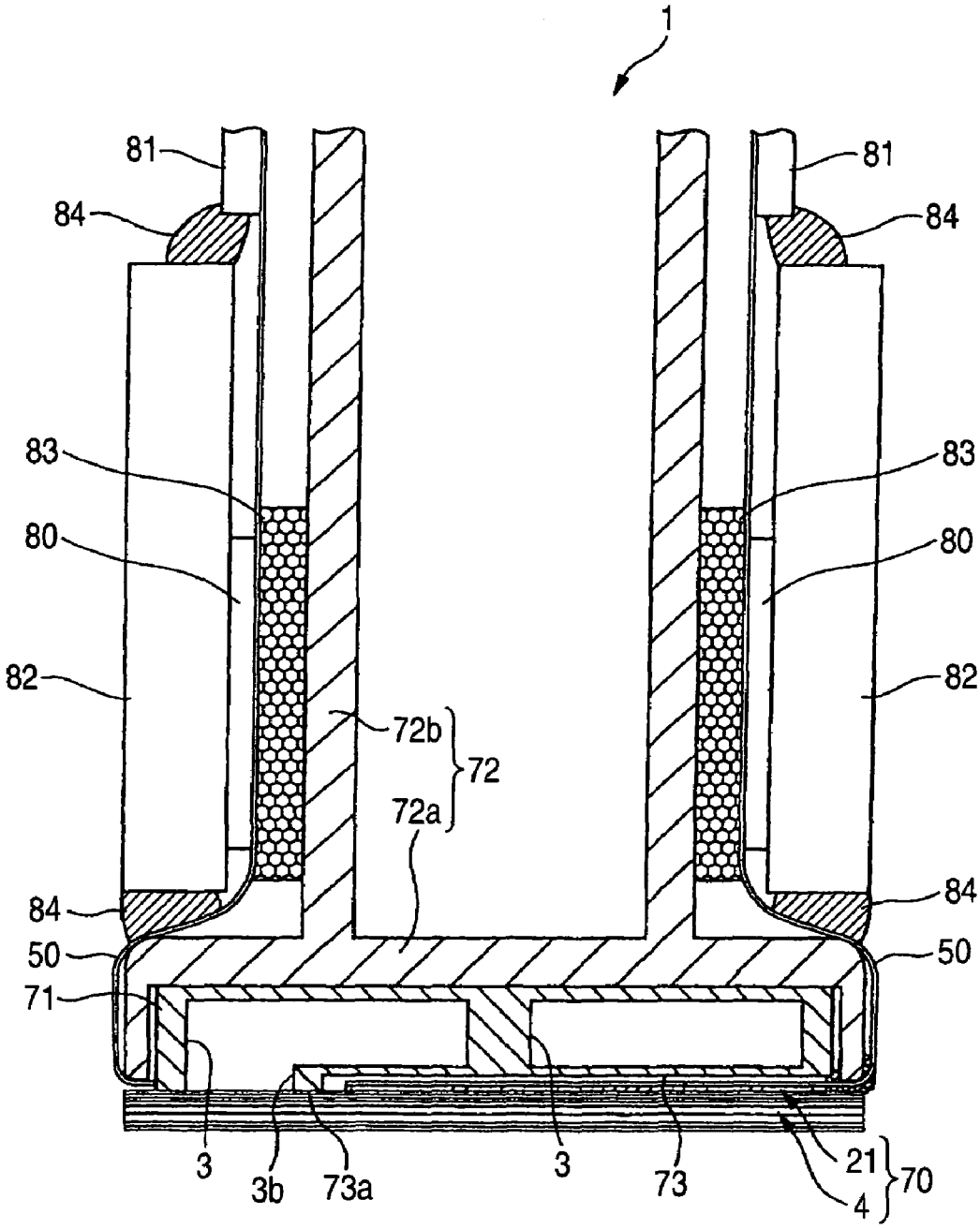
FIG. 2 is a sectional view taken along the line II-II in FIG. 1.

Hereinbelow, a description will be made of an inkjet printing head 1, which is manufactured by a method according to a first embodiment. FIG. 1 is a perspective view showing the external appearance of an inkjet printing head according to a first embodiment. FIG. 2 is a sectional view taken along the line II-II in FIG. 1. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70.

The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and fixed to one another. Flexible printed circuit boards (hereinafter referred to as FPCs) 50 which are feeder circuit members are bonded onto an upper surface of the actuator units 21 and pulled out in left and right direction. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 (shown in FIG. 3) only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are fixed to one another by the seal members 84.

Figure 3:
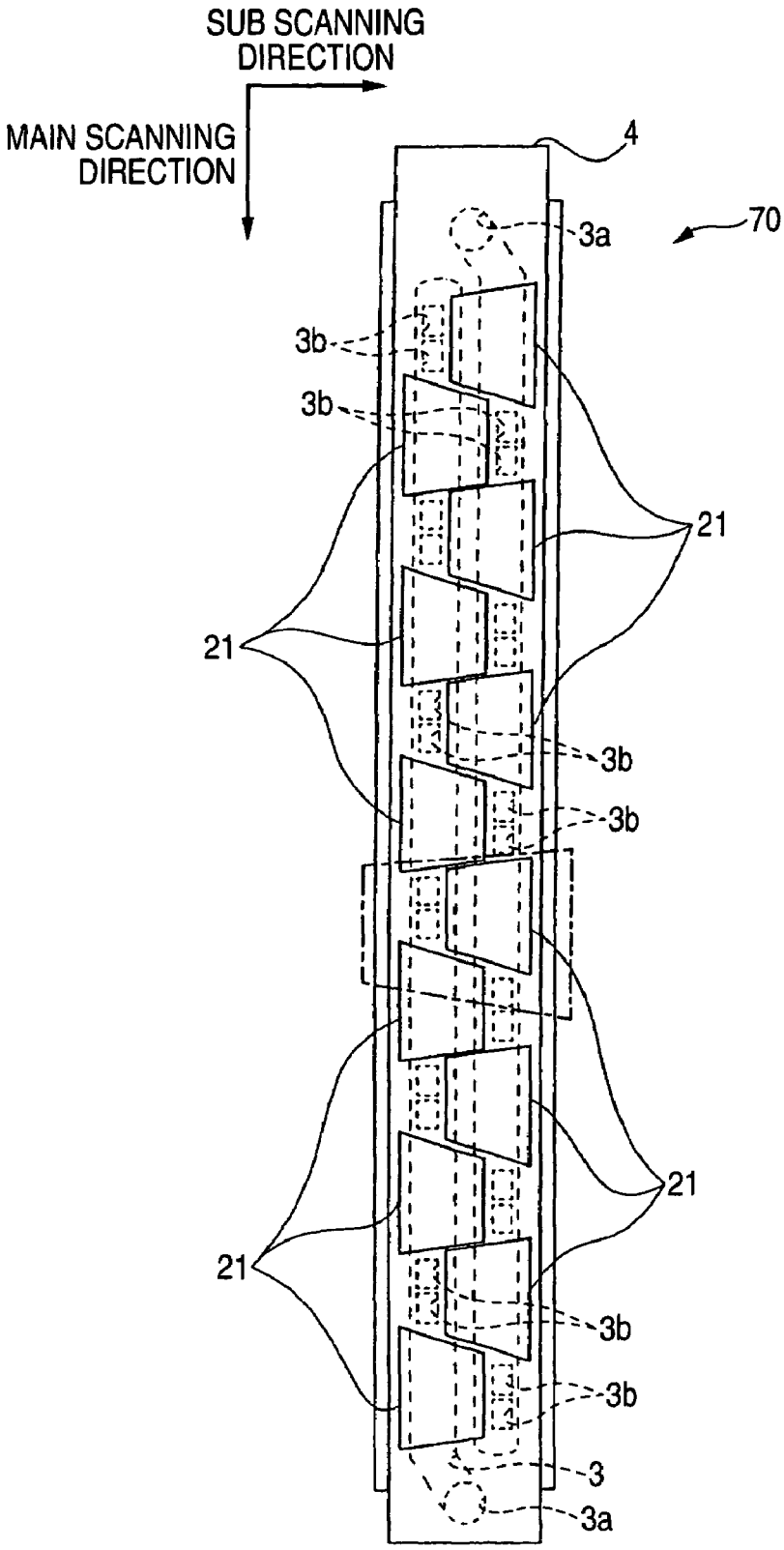
FIG. 3 is a plan view of a head body included in the inkjet printing head depicted in FIG. 1.

FIG. 3 is a plan view of the head body included in the inkjet printing head depicted in FIG. 1. In FIG. 3, the ink reservoirs 3 formed in the base block 71 are drawn imaginaryly by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are arranged in staggered layout.

The plurality of actuator units 21 each having a trapezoid flat shape are disposed in regions where the openings 3*b* are not provided. The plurality of actuator units 21 are arranged in staggered layout so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 10.

Figure 4:
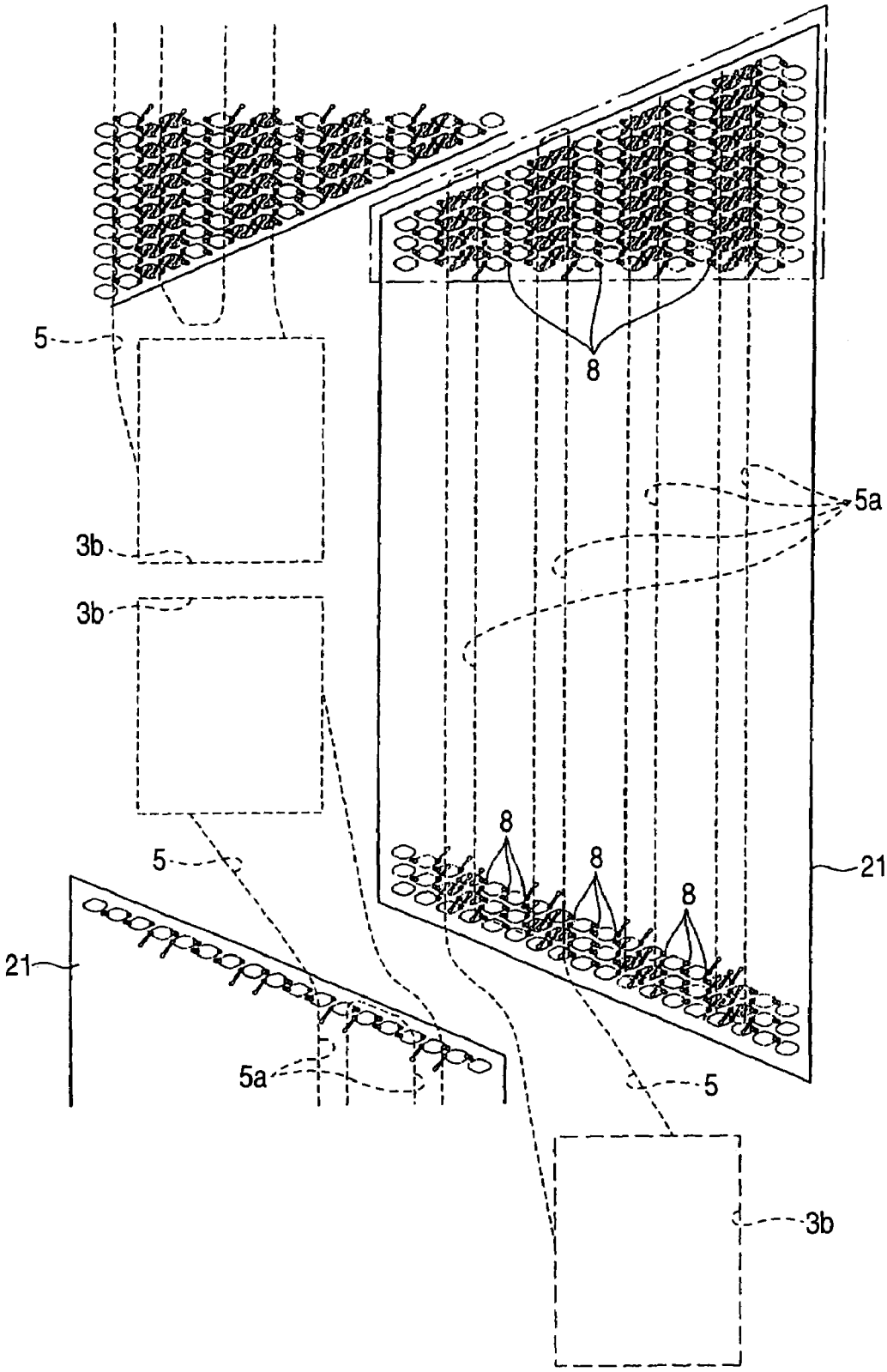
FIG. 4 is an enlarged view of a region surrounded by the chain line shown in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually arranged on the whole of the ink ejection region.

Figure 5:
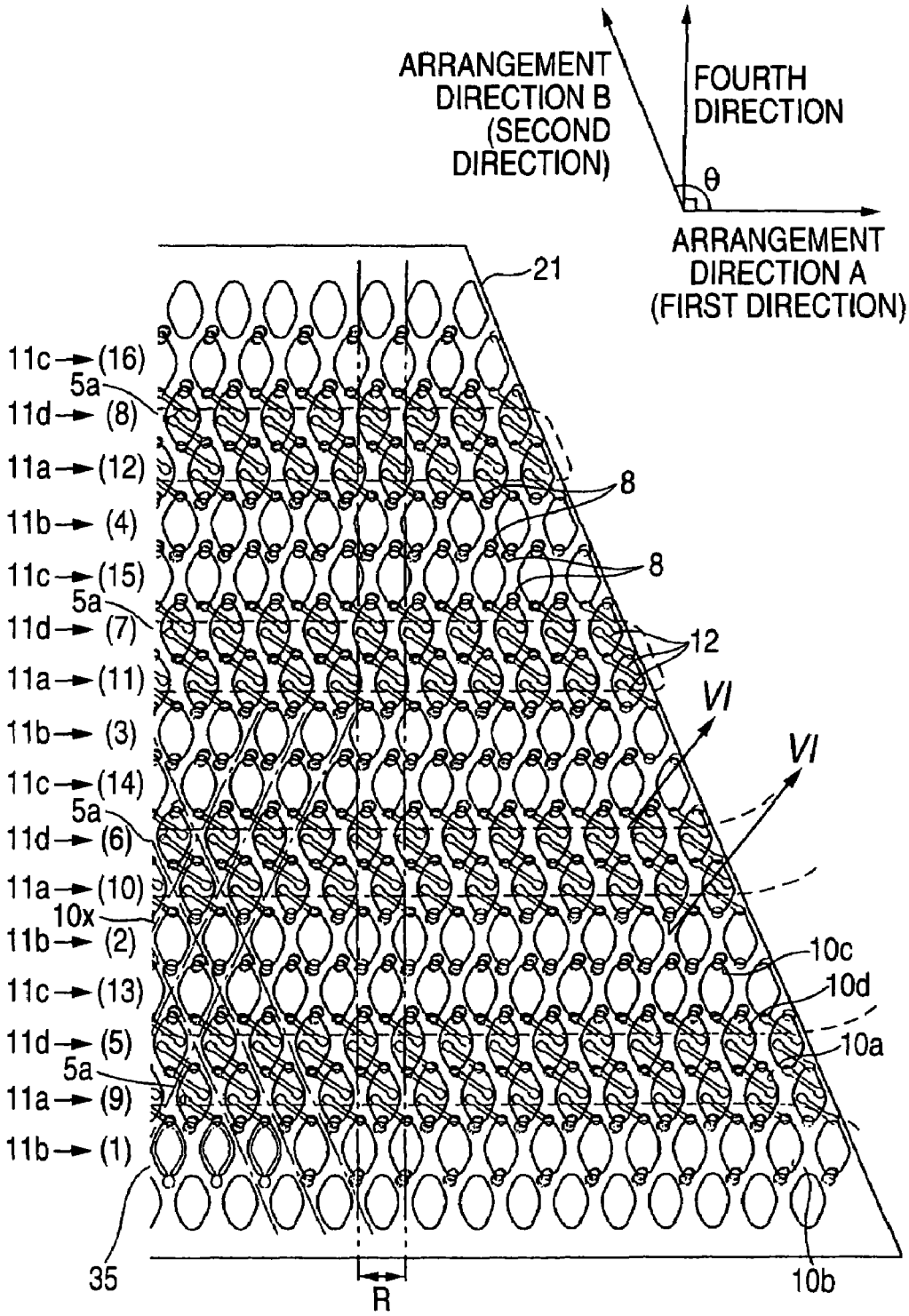
FIG. 5 is an enlarged view of a region surrounded by the chain line shown in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 as one end connected to a corresponding nozzle 8, and the other end connected to a corresponding sub manifold 5*a* as a common ink flow path through an aperture 12. An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 5 for the sake of simplification. Incidentally, the pressure chambers 10 and apertures 12 that must be expressed by the broken line in the actuator units 21 or in the flow path unit 4 are expressed by the solid line in FIGS. 4 and 5 to make it easy to understand the drawings.

In FIG. 5, a plurality of imaginary rhombic regions 10 in which the pressure chambers 10 are stored respectively are disposed adjacently in the form of a matrix both in an arrangement direction A (first direction) and in an arrangement direction B (second direction) so that adjacent imaginary rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that eighteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*-> . . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6:
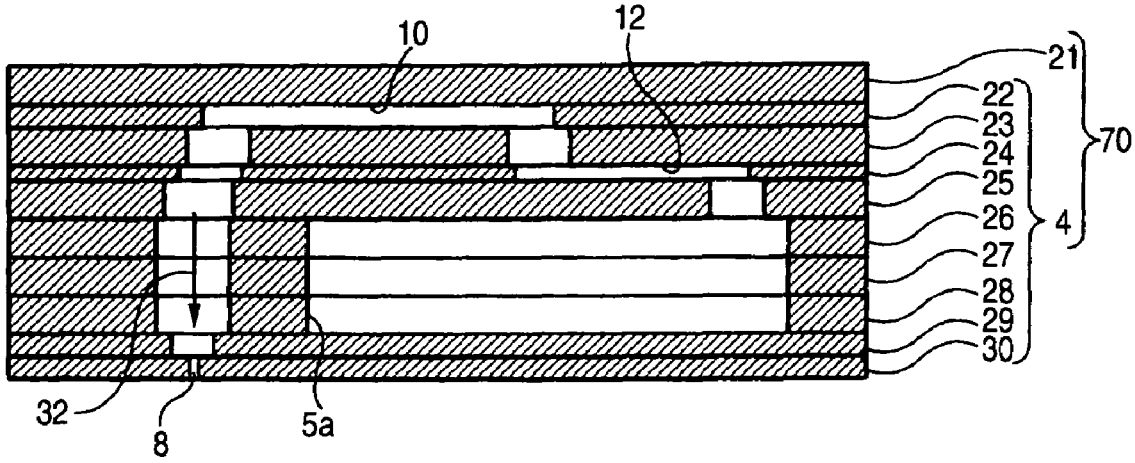
FIG. 6 is a sectional view taken along the line VI-VI in FIG. 5.
Figure 7:
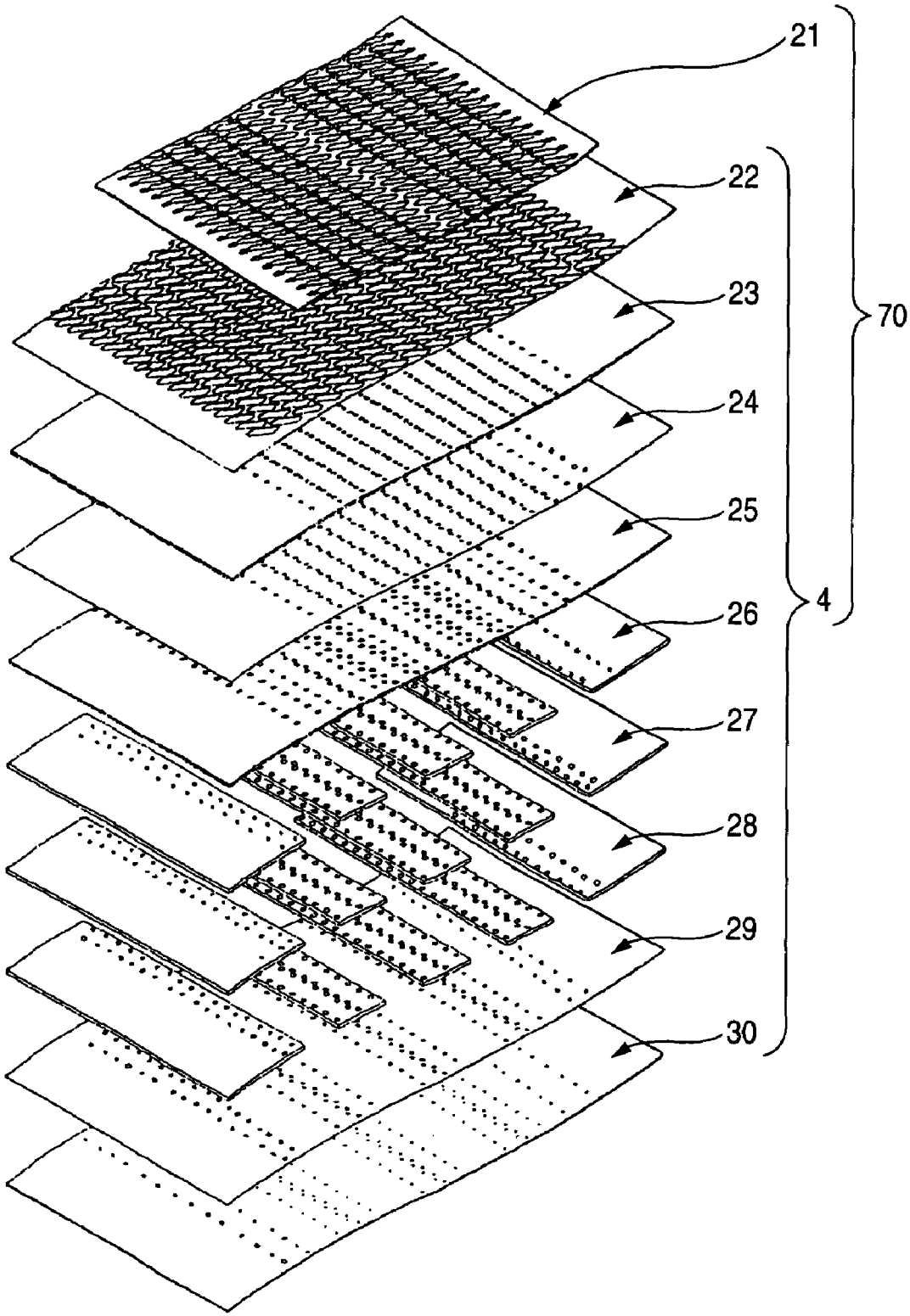
FIG. 7 is a partially exploded perspective view of the head body depicted in FIG. 6.

Next, the sectional structure of the head body 70 will be described more specifically with reference to FIGS. 6 and 7. FIG. 6 is a sectional view taken along the line VI-VI in FIG. 5. A pressure chamber 10*a* belonging to a first pressure chamber column 11*a* is shown in FIG. 6. FIG. 7 is a partially exploded perspective view of the head body. As is obvious from FIG. 6, each nozzle 8 is connected to a sub manifold 5*a* through the pressure chamber 10 (10*a*) and an aperture 12. In this manner, an individual ink flow path 32 for leading ink from an outlet of the sub manifold 5*a* to the nozzle 8 through the aperture 12 and the pressure chamber 10 is formed in the head body 70 so as to be disposed in accordance with every pressure chamber 10.

As is also obvious from FIG. 7, the head body 70 has a laminated structure in which ten sheet materials in total are laminated on one another, that is, an actuator unit 21, a cavity plate 22, a base plate 23, an aperture plate 24, a supply plate 25, manifold plates 26, 27 and 28, a cover plate 29 and a nozzle plate 30 are laminated successively in descending order. The ten sheet materials except the actuator unit 21, that is, nine metal plates form a flow path unit 4. The respective metal plates are collectively fixed to one another by diffusion junction.

As will be described later in detail, the actuator unit 21 includes a laminate of four piezoelectric sheets 41 to 44 (see FIG. 8A) as four layers, and electrodes disposed so that only the uppermost layer is provided as a layer having a portion serving as an active layer at the time of application of electric field (hereinafter simply referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding ink nozzle 8. The aperture plate 24 is a metal plate which has apertures 12 formed as half-etching regions each for connecting two holes in one pressure chamber 10 of the cavity plate 22, and holes each for connecting one pressure chamber 10 of the cavity plate 22 to a corresponding ink nozzle 8. The supply plate 25 is a metal plate which has holes each for connecting an aperture 12 for one pressure chamber 10 of the cavity plate 22 to a corresponding sub manifold 5*a*, and holes each for connecting the pressure chamber 10 to the ink nozzle 8. The manifold plates 26, 27 and 28 are metal plates which have holes 26*c*, 27*c* and 28*c* connected to one another at the time of lamination for forming the manifolds 5*a*, and holes each for connecting one pressure chamber 10 of the cavity plate 22 to a corresponding ink nozzle 8. The cover plate 29 is a metal plate which has holes each for connecting one pressure chamber 10 of the cavity plate 22 to a corresponding ink nozzle 8. The nozzle plate 30 is a metal plate which has nozzles 8 each provided for one pressure chamber 10 of the cavity plate 22.

In the embodiment, the apertures 12 serves as a restricted flow path that restricts flow of the ink and provided between the common ink chamber (manifolds 5) and the pressure chamber 10 in the individual ink flow path.

The nine metal plates are laminated on one another while positioned so that individual ink flow paths 32 as shown in FIG. 6 are formed. Each of the individual ink flow paths 32 first extends upward from the sub manifold 5*a*, extends horizontally in the aperture 12, extends further upward, extends horizontally in the pressure chamber 10 again, extends obliquely downward for a while in a direction of departing from the aperture 12 and extends vertically downward to the nozzle 8.

Figure 8A:
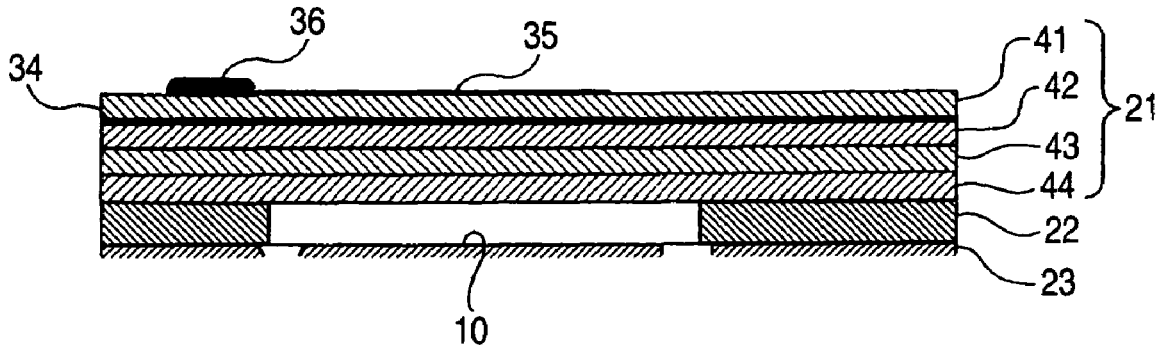
FIG. 8A is an enlarged view of an actuator unit depicted in FIG. 6.
Figure 8B:
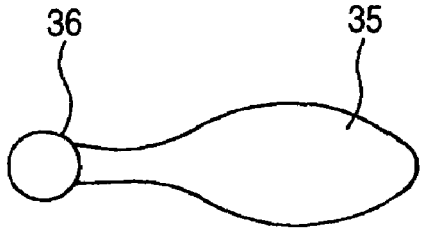
FIG. 8B is an enlarged view of each individual electrode mounted on the actuator unit.

Next, the configuration of the actuator unit 21 laminated on the cavity plate 22 as the uppermost layer of the flow path unit 4 will be described. FIG. 8A is a partially enlarged sectional view showing the actuator unit 21 and a pressure chamber 10. FIG. 8B is a plan view showing the shape of an individual electrode bonded to a surface of the actuator unit 21.

As shown in FIG. 8A, the actuator unit 21 includes four piezoelectric sheets 41, 42, 43 and 44 formed to have a thickness of about 15 μm equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2 μm is interposed between the piezoelectric sheet 41 as the uppermost layer and the piezoelectric sheet 42 located under the piezoelectric sheet 41 so that the common electrode 34 is formed on the whole surface of the piezoelectric sheet 42. Incidentally, no electrodes are provided between the piezoelectric sheet 42 and the piezoelectric sheet 43. The individual electrodes 35 and the common electrode 34 are made of a metal material such as Ag—Pd.

As shown in FIG. 8B, each individual electrode 35 has a thickness of about 1 μm and substantially has a rhomboid shape nearly similar to the shape of the pressure camber 10 shown in FIG. 5. An acute-angled portion of each approximately rhomboid individual electrode 35 extends. A circular land portion 36 having a diameter of about 160 μm is provided at an end of the extension of the acute-angled portion of the individual electrode 35 so as to be electrically connected to the individual electrode 35. For example, the land portion 36 is made of gold containing glass frit. As shown in FIG. 8A, the land portion 36 is bonded onto a surface of the extension of the individual electrode 35.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., tar from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 8A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

On this occasion, the predetermined timing is equivalent to the point of time when the negative pressure generated by temporary releasing of the deformation of the piezoelectric sheets 41 to 44 on the basis of inputting of an ejection request propagates through the aperture 12 and returns to the pressure chamber 10 while the phase is inverted at the manifold 5*a* as an opening end. When the piezoelectric sheets 41 to 44 are displaced at this timing to reduce the volume of the pressure chamber 10, a required proper amount of an ink droplet can be ejected from the nozzle 8 because positive pressure inverted and reflected is added even in the case where the amount of the displacement is small. That is, in this drive method, the flow path for leading ink to the sub manifold 5*a*, as well as the pressure chamber 10, contributes to ink ejection in the same manner as in the function of the pressure chamber 10 in the aforementioned drive method.

Incidentally, in another drive method, the electric potential of each individual electrode 35 may be set to be different from the electric potential of the common electrode 34 in advance. The electric potential of the individual electrode 35 is temporarily set to be equal to the electric potential of the common electrode 34 whenever there is an ejection request. Then, the electric potential of the individual electrode 35 is returned to the original value different from the electric potential of the common electrode 34 at predetermined timing. In this case, the shape of the whole of the piezoelectric sheets 41 to 44 returns to the original shape at the timing when the electric potential of the individual electrode 35 is set to be equal to the electric potential of the common electrode 34. As a result, the volume of the pressure chamber 10 is increased compared with the initial state (in which the individual electrode 35 and the common electrode 34 are different in electric potential), so that ink is sucked from the sub manifold 5*a* side into the pressure chamber 10. The piezoelectric sheets 41 to 44 are then deformed so as to be curved convexly on the pressure chamber 10 side at the timing when the electric potential of the individual electrode 35 is returned to the original value different from the electric potential of the common electrode 34. As a result, the volume of the pressure chamber 10 is reduced to increase the pressure of ink, so that ink is ejected.

Next, a method for manufacturing the head body 70 will be described. The head body 70 is manufactured in such a manner that the actuator unit 21 and the flow path unit 4 are bonded to each other by an adhesive agent.

Figure 9:
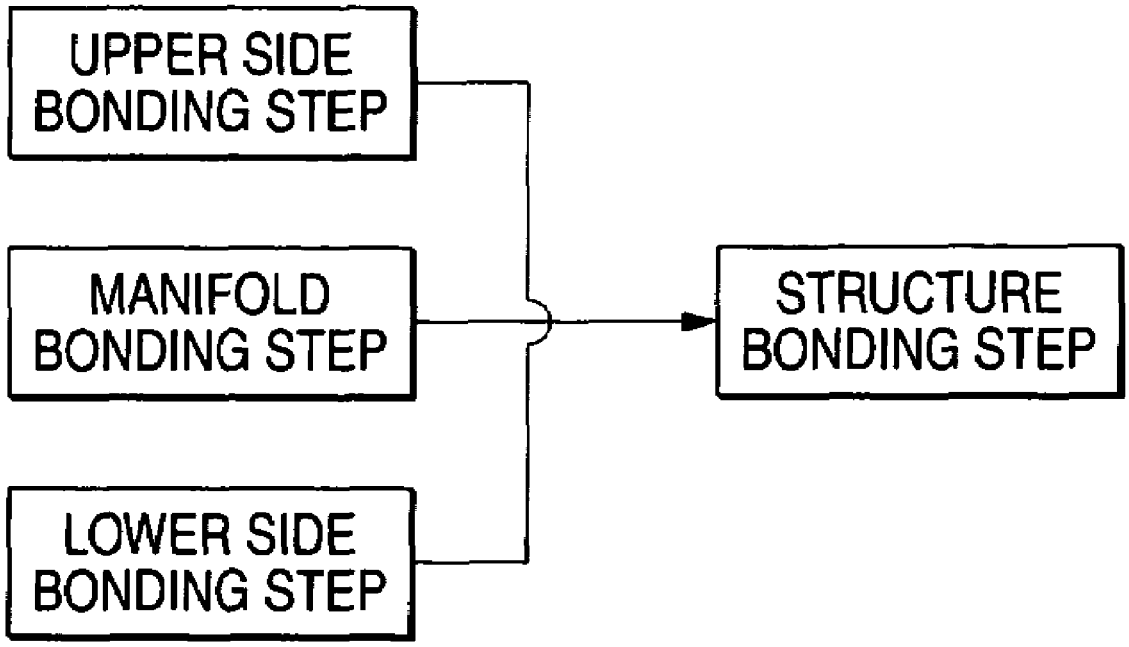
FIG. 9 is a block diagram showing steps for forming a flow path unit depicted in FIG. 6.
Figure 10:
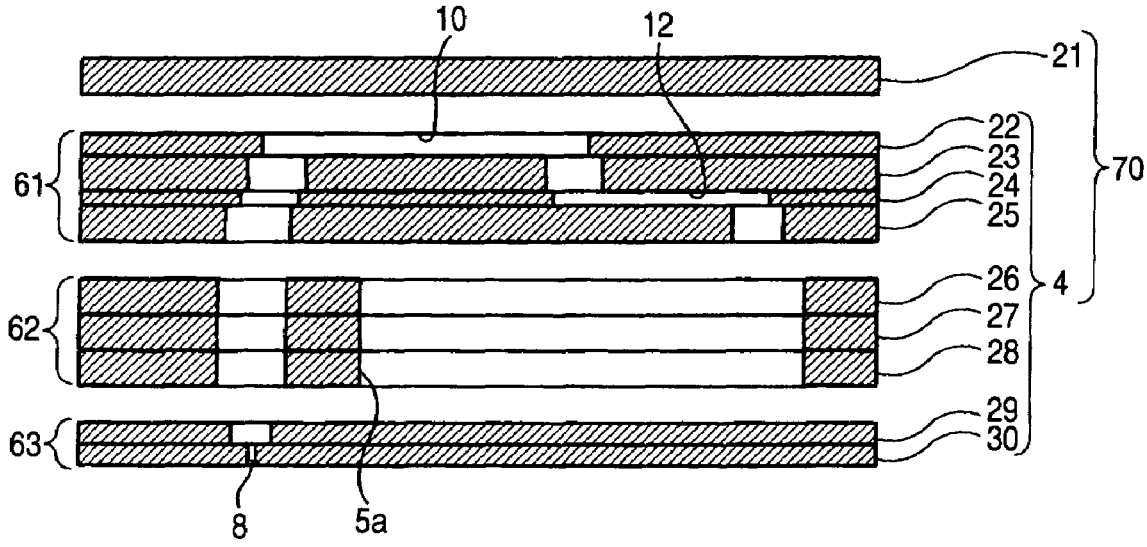
FIG. 10 is a view for explaining the steps in the ink-jet printing head manufacturing method depicted in FIG. 9.

FIG. 9 is a block diagram showing steps for forming the flow path unit 4. FIG. 10 is a view for explaining the steps. As shown in FIGS. 9 and 10, the method for manufacturing an inkjet printing head includes: an upper side fixing step for forming an upper structure (first laminated structure) 61 (first fixing is step); a manifold fixing step for forming a manifold structure (second laminated structure) 62 (second fixing step); a lower side fixing step for forming a lower structure (first laminated structure) 63 (first fixing step); and a structure fixing step for forming the flow path unit 4 (third fixing step).

In the upper side fixing step, a cavity plate 22, a base plate 23, an aperture plate 24 and a supply plate 25 are collectively fixed to one another by diffusion junction to form the upper structure 61. In the manifold fixing step, three manifold plates 26, 27 and 28 are collectively fixed to one another by diffusion junction to form the manifold structure 62. In the lower side fixing step, a cover plate 29 and a nozzle plate 30 are diffusion-bonded to each other to form the lower structure 63. In the structure fixing step, the upper structure 61 formed by the upper side fixing step, the manifold structure 62 formed by the manifold fixing step and the lower structure 63 formed by the lower side fixing step are fixed to one another by an adhesive agent to form the flow path unit 4. Incidentally, the upper side fixing step, the manifold fixing step, and the lower side fixing step can be executed simultaneously in a vacuum atmosphere before the structure fixing step is executed.

According to the first embodiment described above, because the upper structure 61 and the lower structure 63 are formed by the upper side fixing step and the lower side fixing step independent of the manifold fixing step, metal plates to be included in the upper and lower structures 61 and 63 can be surely fixed to one another by metal-metal junction under sufficient pressure.

In the upper side fixing step, the upper structure 61 including the pressure chambers 10 and the apertures 12 is formed by means of diffusion junction. Accordingly, the adhesive agent does not flow into the pressure chambers 10 and the apertures 12, so that both variation in flow path resistance and choking of the flow paths can be prevented. As a result, uniformity of ink ejection characteristic of the inkjet printing head 1 can be improved.

Moreover, the upper structure 61 includes the supply plate 25 which serves as a wall of the sub manifolds 5*a*. Accordingly, the adhesive agent does not flow into the apertures 12 in the structure fixing step.

In addition, in the structure fixing step, the upper structure 61, the manifold structure 62 and the lower structure 63 are fixed to one another by an adhesive agent. Accordingly, the inkjet printing head 1 can be manufactured with good efficiency and at low cost compared with the case where these structures are fixed to one another by means of diffusion junction.

In the upper side fixing step, the manifold fixing step, and the lower side fixing step, respective metal plates are fixed to one another by means of diffusion junction. Accordingly, the adhesive agent does not flow into other ink flow paths formed in the inside of the inkjet printing head 1, so that both variation in flow path resistance and choking of the flow paths can be prevented.

Second Embodiment

A second embodiment of the invention will be described below with reference to the drawings.

The inkjet printing head manufactured by the inkjet printing head manufacturing method according to the second embodiment is substantially the same as the inkjet printing head 1 manufactured by the inkjet printing head manufacturing method according to the first embodiment. The description of the inkjet printing head manufactured by the inkjet printing head manufacturing method according to the second embodiment will be omitted.

A method for manufacturing the head body 70 will be described. The head body 70 is manufactured in such a manner that the actuator unit 21 and the flow path unit 4 are bonded to each other by an adhesive agent.

Figure 11:
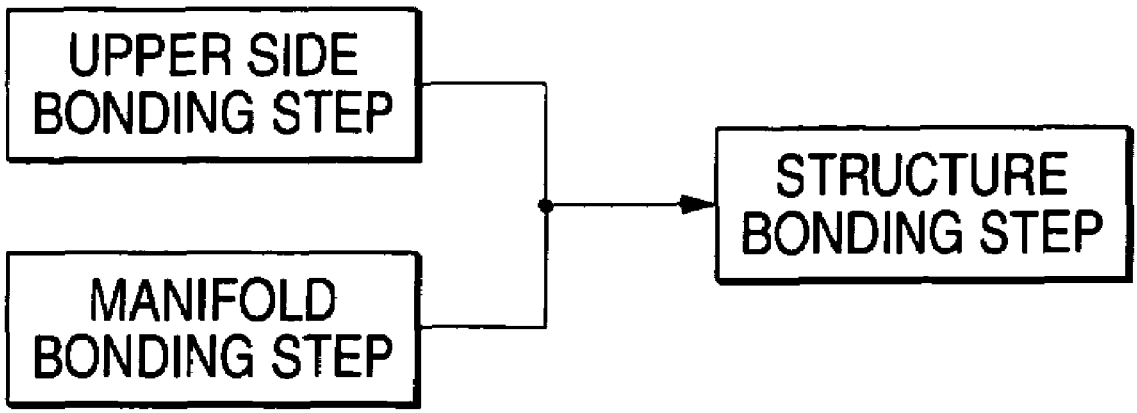
FIG. 11 is a block diagram showing steps for forming the flow path unit depicted in FIG. 6 in an inkjet printing head manufacturing method according to a second embodiment of the invention.
Figure 12:
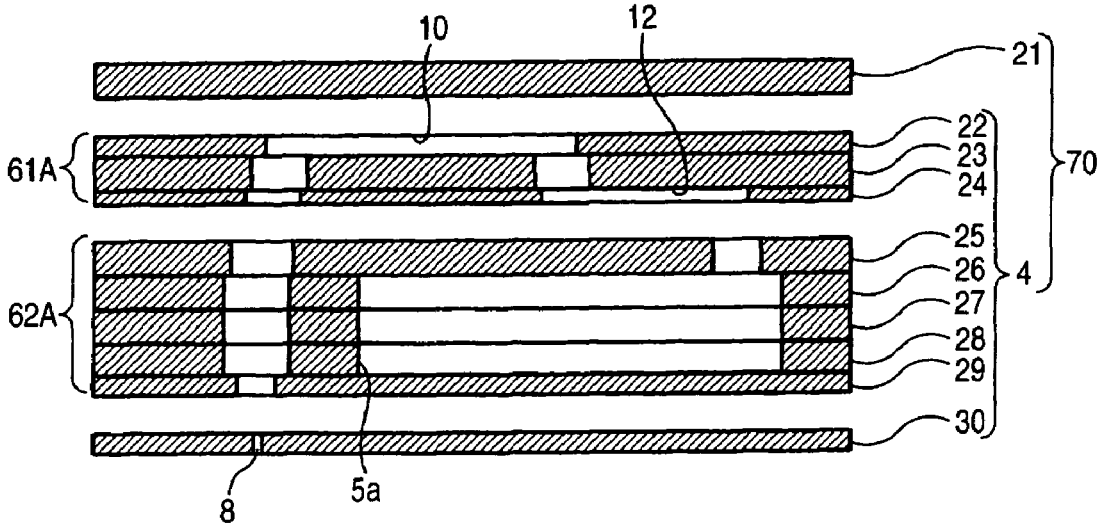
FIG. 12 is a view for explaining the steps in the inkjet printing head manufacturing method depicted in FIG. 11.

FIG. 11 is a block diagram showing steps for forming the flow path unit 4. FIG. 12 is a view for explaining the steps. As shown in FIGS. 11 and 12, the method of manufacturing an inkjet printing head includes: an upper side fixing step for forming an upper structure (first laminated structure) 61A (first fixing step); a manifold fixing step for forming a manifold structure (second laminated structure) 62A (second fixing step); and a structure fixing step for forming the flow path unit 4 (third fixing step).

In the upper side fixing step, a cavity plate 22, a base plate 23 and an aperture plate 24 are collectively fixed to one another by diffusion junction to form the upper structure 61A. In the manifold fixing step, a supply plate 25, three manifold plates 26, 27 and 28 and a cover plate 29 are collectively fixed to one another by diffusion junction to form the manifold structure 62A. In the structure fixing step, the upper structure 61A formed by the upper side fixing step, the manifold structure 62A formed by the manifold fixing step and a nozzle plate 30 are fixed to one another by an adhesive agent to form the flow path unit 4. Incidentally, the upper side fixing step and the manifold fixing step can be executed simultaneously in a vacuum atmosphere before the structure fixing step is executed.

According to the second embodiment described above, because the upper structure 61A is formed by the upper side fixing step independent of the manifold fixing step, metal plates to be included in the upper structures 61A can be surely fixed to one another by metal-metal junction under sufficient pressure.

In the upper side fixing step, the upper structure 61A including the pressure chambers 10 and the apertures 12 is formed by means of diffusion junction. Accordingly, the adhesive agent does not flow into the pressure chambers 10 and the apertures 12, so that both variation in flow path resistance and choking of the flow paths hardly occur. As a result, uniformity of ink ejection characteristic of the inkjet printing head 1 can be improved.

In addition, in the structure fixing step, the upper structure 61A, the manifold structure 62A and the nozzle plate 30 are fixed to one another by an adhesive agent. Accordingly, the inkjet printing head 1 can be manufactured with good efficiency and at low cost compared with the case where these structures are fixed to one another by means of diffusion junction.

In the upper side fixing step and the manifold fixing step, respective metal plates are fixed to one another by means of diffusion junction. Accordingly, the adhesive agent does not flow into other ink flow paths formed in the inside of the inkjet printing head 1.

Although preferred embodiments of the invention have been described above, the invention is not limited to the embodiments and various changes may be made without departing from the scope of claim. For example, though the first and second embodiments have shown the configuration in which all metal plates are fixed to one another by diffusion junction in the upper side fixing step, the invention is not limited to the configuration. For example, a configuration in which at least two metal plates are is fixed to one another by diffusion junction, such as a configuration in which the base plate 23 and the aperture plate 24 are selectively diffusion-bonded to each other may be used. In this case, other metal plates may be fixed to one another by an adhesive agent. Incidentally, the apertures 12 sensitively exert influence on ink ejection characteristic when the adhesive agent flows into the apertures 12 at the time of bonding. It is therefore effective from the point of view of greater uniformity of ejection characteristic in the first embodiment that the aperture plate 24 having the apertures 12 formed therein is diffusion-bonded to the base plate 23 and the supply plate 25 laminated adjacently on the aperture plate 24.

Although the first and second embodiments have shown the configuration in which at least the cavity plate 22, the base plate 23 and the aperture plate 24 are fixed to one another in the upper side fixing step, the invention is not limited to the configuration. For example, in the upper side fixing step, metal plates not including part or all of these plates may be fixed to one another.

Although the first and second embodiments have shown the configuration in which only metal plates for forming the sub manifolds 5*a* are fixed to one another in the manifold fixing step, the invention is not limited to the configuration as long as metal plates for forming at least part of the sub manifolds 5*a* can be fixed to one another. For example, besides the metal plates for forming the sub manifolds 5*a*, other metal plates may be fixed to one another.

Although the first and second embodiments have shown the configuration in which metal plates are fixed to one another by diffusion junction in the manifold fixing step, the invention is not limited to the configuration. For example, metal plates may be fixed to one another by an adhesive agent or bonding using such an adhesive agent may be mixed with diffusion junction. In this case, the inkjet printing head 1 can be manufactured with good efficiency and at low cost compared with the case where only diffusion junction is used.

Although the first and second embodiments have shown the configuration in which all sheet materials for forming the flow path unit 4 are metal plates, the invention is not limited to the configuration. If at least two of sheet materials fixed to one another in the upper side fixing step are metal plates, any materials may be used as the other sheet materials. Incidentally, bonding of sheet materials other than the metal plates can be achieved by another bonding method such as a method using an adhesive agent. Also in this case, it is effective from the point of view of uniformity of ejection characteristic in the first embodiment that the base plate 23, the aperture plate 24 and the supply plate 25 are provided as metal plates and fixed to one another by means of diffusion junction.

Although the first and second embodiments have shown the configuration in which the structures 61 to 63 or the structures 61A and 62A and the metal plate are fixed to one another by an adhesive agent in the structure fixing step, the invention is not limited to the configuration. For example, the structures 61 to 63 or the structures 61A and 62A and the metal plate may be fixed to one another by means of diffusion junction. In this case, the adhesive agent does not flow into other ink flow paths formed in the inside of the inkjet printing head. Particularly in the second embodiment, it is preferable that at least two structures 61A and 62A for forming the apertures 12 are bonded to each other by means of diffusion junction.

In addition, though the first and second embodiments have shown the configuration in which diffusion junction is used as the metal-metal junction, the invention is not limited to the configuration. For example, diffusion junction may be replaced by solder bonding as the metal-metal junction. Incidentally, when solder bonding is used, metal plates such as copper-plated, silver-plated or gold-plated metal plates good in wettability to solder or stainless steel plates containing at least one of these elements are fixed to one another at a high temperature in a vacuum atmosphere.

Although the first and second embodiments have shown the configuration in which the upper side fixing step, the manifold fixing step and the lower side fixing step (used only in the first embodiment) are executed simultaneously, the sequence of execution of the steps is not particularly limited. For example, the upper side fixing step, the manifold fixing step and the lower side fixing step may be executed successively or the upper side fixing step and the lower side fixing step may be executed after the manifold fixing step.

Figure 13:
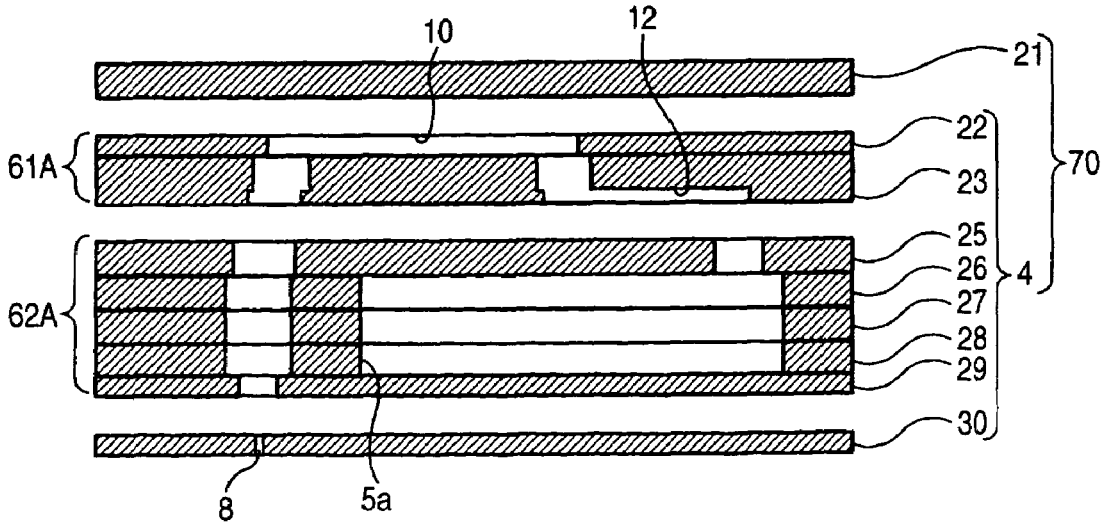
FIG. 13 is a view for explaining the sectional structure of the inkjet printing head according to another embodiment.

In the second embodiment, the upper structure 61A includes three plates of the cavity plate 22, the base plate 23 and the aperture plate 24, as shown in FIG. 12. However, as shown in FIG. 13, the upper structure 61A may be formed by two plates of the cavity 22 and the base plate 23 being fixed to each other by metal-metal junction. In the case shown in FIG. 13, the aperture 12 is provided as a groove formed on one surface of the base plate 23. The groove may be formed by applying a half-etching to the surface of the base plate 23. According to this configuration, the number of plates to be fixed for the upper structure 61A can be reduced, and the difficulty in fixing the plates can be lowered.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of manufacturing an inkjet printing head, the method comprising:

forming a first laminated structure that includes at least a part of an individual ink flow path having a pressure chamber and leads ink from an outlet of a common ink chamber to a nozzle through the pressure chamber, by laminating at least two metal plates having a hole formed thereon and fixing the metal plates to one another by metal-metal junction, and by laminating a plurality of thin plate members having a hole formed thereon, the thin plate members including the metal plates, and fixing the thin plate members to one another;

forming a second laminated structure that includes at least a part of the common ink chamber, by laminating a plurality of thin plate members having a hole formed thereon and fixing the thin plate members to one another; and fixing the first laminated structure and the second laminated structure to each other while laminating the first laminated structure and the second laminated structure on each other;

wherein the metal plates include a metal plate that provides a restricted flow path that restricts flow of the ink and is provided between the common ink chamber and the pressure chamber in the individual ink flow path, and the metal plate that provides the restricted flow path has a groove formed thereon, the groove serving as the restricted flow path.

2. The method according to claim 1, wherein a diffusion junction is used as the metal-metal junction in fixing the metal plates.

3. The method according to claim 1, wherein a solder bonding is used as the metal-metal junction in fixing the metal plates.

4. The method according to claim 1, wherein the groove is formed by half-etching applied to a surface of the metal plate.

5. The method according to claim 1, wherein the hole formed on the metal plate that provides the restricted flow path serves as the restricted flow path.

6. The method according to claim 5, wherein the metal plates include a metal plate that provides the restricted flow path, and at least two metal plates that support the metal plate that provides the restricted flow path from both surfaces.

7. The method according to claim 6, wherein one of the two metal plates provides the pressure chamber, and the other of the two metal plates serves as a part of the common ink chamber.

8. The method according to claim 1, wherein the metal plates include a metal plate that provides the pressure chamber.

9. The method according to claim 1, wherein all of the thin plate members included in the first laminated structure are made of metal and are fixed to one another by metal-metal junction.

10. The method according to claim 9, wherein a diffusion junction is used as the metal-metal junction in fixing the thin plate members of the first laminated structure.

11. The method according to claim 9, wherein a solder bonding is used as the metal-metal junction in fixing the thin plate members of the first laminated structure.

12. The method according to claim 9, wherein the thin plate members included in the first laminated structure include a thin plate member that serves as a wall of the common ink chamber.

13. The method according to claim 9, wherein the thin plate members included in the second laminated structure exclusively includes a thin plate member that serves as a wall of the common ink chamber.

14. The method according to claim 1, wherein the thin plate members of the second laminated structure are fixed to one another by adhesive agent.

15. The method according to claim 1, wherein the thin plate members of the second laminated structure are fixed to one another by metal-metal junction.

16. The method according to claim 15, wherein a diffusion junction is used as the metal-metal junction in fixing the thin plate members of the second laminated structure.

17. The method according to claim 15, wherein a solder bonding is used as the metal-metal junction in fixing the thin plate members of the second laminated structure.

18. The method according to claim 1, wherein the first laminated structure and the second laminated structure are fixed to each other by an adhesive agent.

19. The method according to claim 1, wherein the first laminated structure and the second laminated structure are fixed to each other by metal-metal junction.

20. The method according to claim 19, wherein a diffusion junction is used as the metal-metal junction in fixing the first laminated structure and the second laminated structure.

21. The method according to claim 19, wherein a solder bonding is used as the metal-metal junction in fixing the first laminated structure and the second laminated structure.

* * * * *